US005729964A

United States Patent [19]

Palmer

[11] Patent Number: 5,729,964

[45] Date of Patent: Mar. 24, 1998

[54] FLOATING FLAP TUCKER

[75] Inventor: Barry W. Palmer, Apple Valley, Minn.

[73] Assignee: Thiele Engineering Company, Edina, Minn.

[21] Appl. No.: 607,209

[22] Filed: Feb. 26, 1996

[51] Int. Cl.[6] ..... B65B 7/16

[52] U.S. Cl. ..... 53/484; 53/491; 53/377.5; 493/137

[58] Field of Search ..... 53/484, 491, 377.5, 53/476, 377.6; 493/136, 137, 140, 139

[56] References Cited

U.S. PATENT DOCUMENTS

| | | | |
|---|---|---|---|
| 3,032,947 | 5/1962 | Voller | 53/377.5 |
| 3,049,847 | 8/1962 | Galloway | 53/377.5 |
| 3,452,515 | 7/1969 | Bongartz et al. | 53/377.5 |
| 4,244,282 | 1/1981 | Ruzand et al. | 493/137 |
| 4,441,303 | 4/1984 | Langen | 53/377.5 |
| 4,584,818 | 4/1986 | Plaskett | 53/377.5 |
| 5,341,621 | 8/1994 | Martelli | 53/377.5 |

FOREIGN PATENT DOCUMENTS

| | | | |
|---|---|---|---|
| 2063204 | 6/1981 | United Kingdom | 53/377.5 |

*Primary Examiner*—James F. Coan
*Assistant Examiner*—Gene L. Kim
*Attorney, Agent, or Firm*—Hugh D. Jaeger

[57] ABSTRACT

Flap tucker assembly and cam actuators for tucking and/or closing a box container flap. One or more flap tucker assemblies, the major elements of which include a slider body, a pivotable tucker blade and a face closer assembly, are carried by a tucker transporter system which presents members of the tucker assembly to be reciprocatingly actuated by cam operators to horizontally and transversely actuate the slide body, to vertically actuate the pivotable tucker blade, and to horizontally and transversely actuate the face closer assembly in sequence as the flap tucker assembly is carried parallel to a box container conveyor.

17 Claims, 11 Drawing Sheets

FLOATING FLAP TUCKER

CROSS REFERENCES TO CO-PENDING APPLICATIONS

None.

BACKGROUND OF THE INVENTION

1. Field of the Invention

The present invention is for a packaging machine component, and more particularly, pertains to a floating flap tucker assembly.

2. Description of the Prior Art

Prior art flap tuckers did not easily tuck the flap into the box and sometimes even caused mistucks, such as jams on a packaging line causing a shutdown of the packaging line.

SUMMARY OF THE INVENTION

The general purpose of the present invention is a floating flap tucker assembly and actuation system.

According to one embodiment of the present invention, there is provided a tucker assembly centering about a configured slide body. The lower slide body includes opposing channels on opposing sides of the slide body. The opposing channels slidingly engage opposing shafts secured between opposing chain link members of a tucker transporter system. A cam follower on the underside of the slide body is operated by a cam to horizontally and transversely position the slide body and its mounted components toward an unclosed box container flap carried on a parallel conveyor. A pivotal tucker blade pivotally secures to the slide body and is actuated horizontally and transversely with the slide body to position over the leading bottom box edge, as well as being positioned vertically by a blade actuation cam for positioning over the leading bottom box edge. The tucker blade is released from influence of the blade actuation cam to depress the lower leading edge of the box container for accommodation of the box flap. Opposing channel members on opposing sides of the upper region of the slide body accommodate the slide shafts of a face closer assembly. The face closer assembly includes a cam follower which is operated by a cam to horizontally and transversely operate the face closer to tuck the box container flap. Springs located about the tucker assembly ensure correct positioning of the tucker assembly members when not engaged by the cam members.

One significant aspect and feature of the present invention is a tucker assembly incorporated as a floating member on a tucker transporter system.

Another significant aspect and feature of the present invention is a slide body which is positioned horizontally and transversely along opposing slide shafts to position a slide body and its associated members.

Yet another significant aspect and feature of the present invention is a cam-actuated pivotable tucker blade which is positioned horizontally and vertically depressed to distend the bottom leading edge of a container box.

Still another significant aspect and feature of the present invention is a face closer assembly which is positioned through opposing channels horizontally and transversely to close a flap member.

An additional significant aspect and feature of the present invention is the incorporation of stabilizer members at each side of the slide body.

A further significant aspect and feature of the present invention is cam actuating members for positioning the members of the tucker assembly.

Having thus described embodiments of the present invention, it is the principal object of the present invention to provide a tucker assembly and actuating devices.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
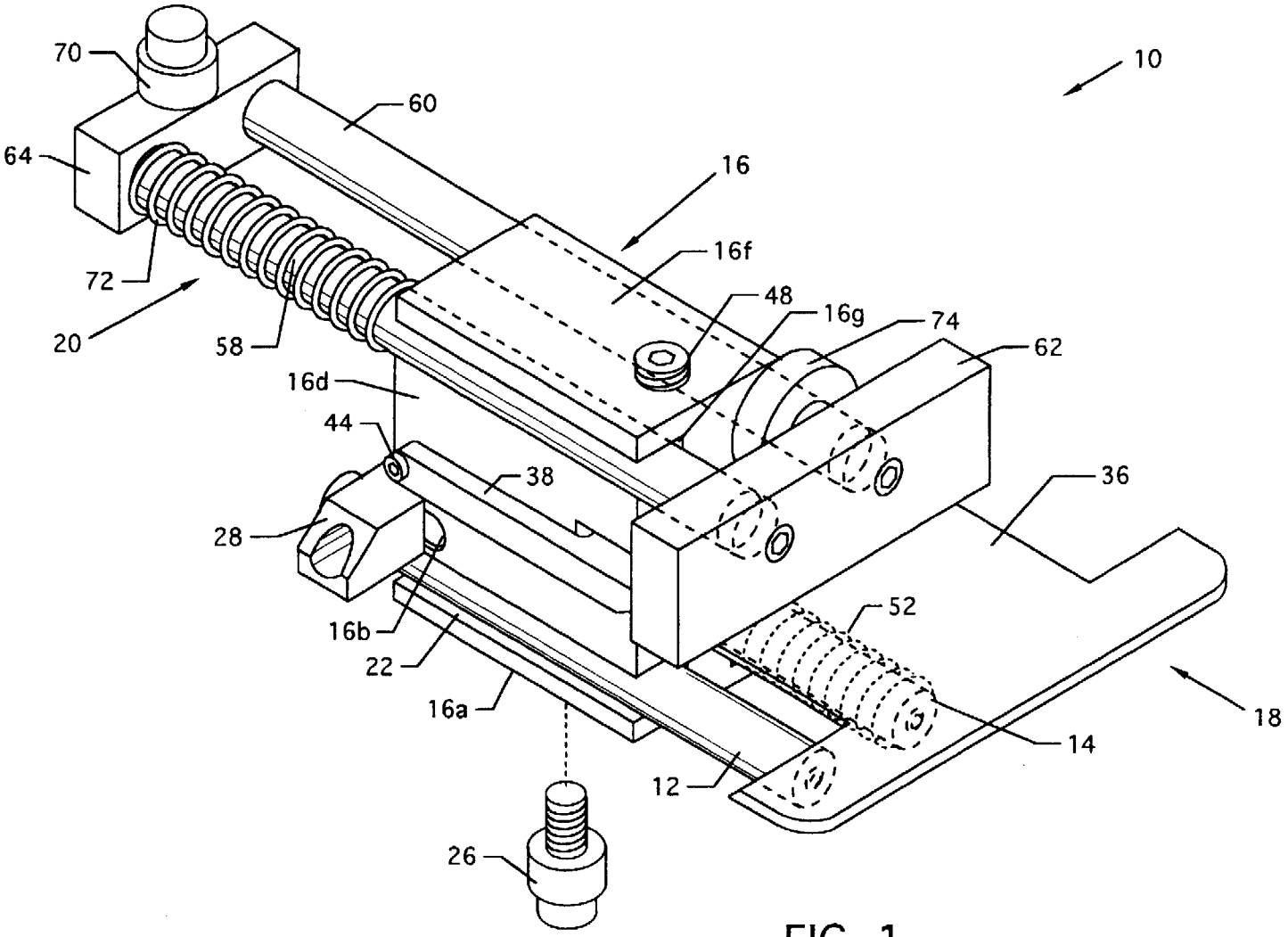
FIG. 1 illustrates an isometric view of the floating flap tucker assembly.
Figure 2:
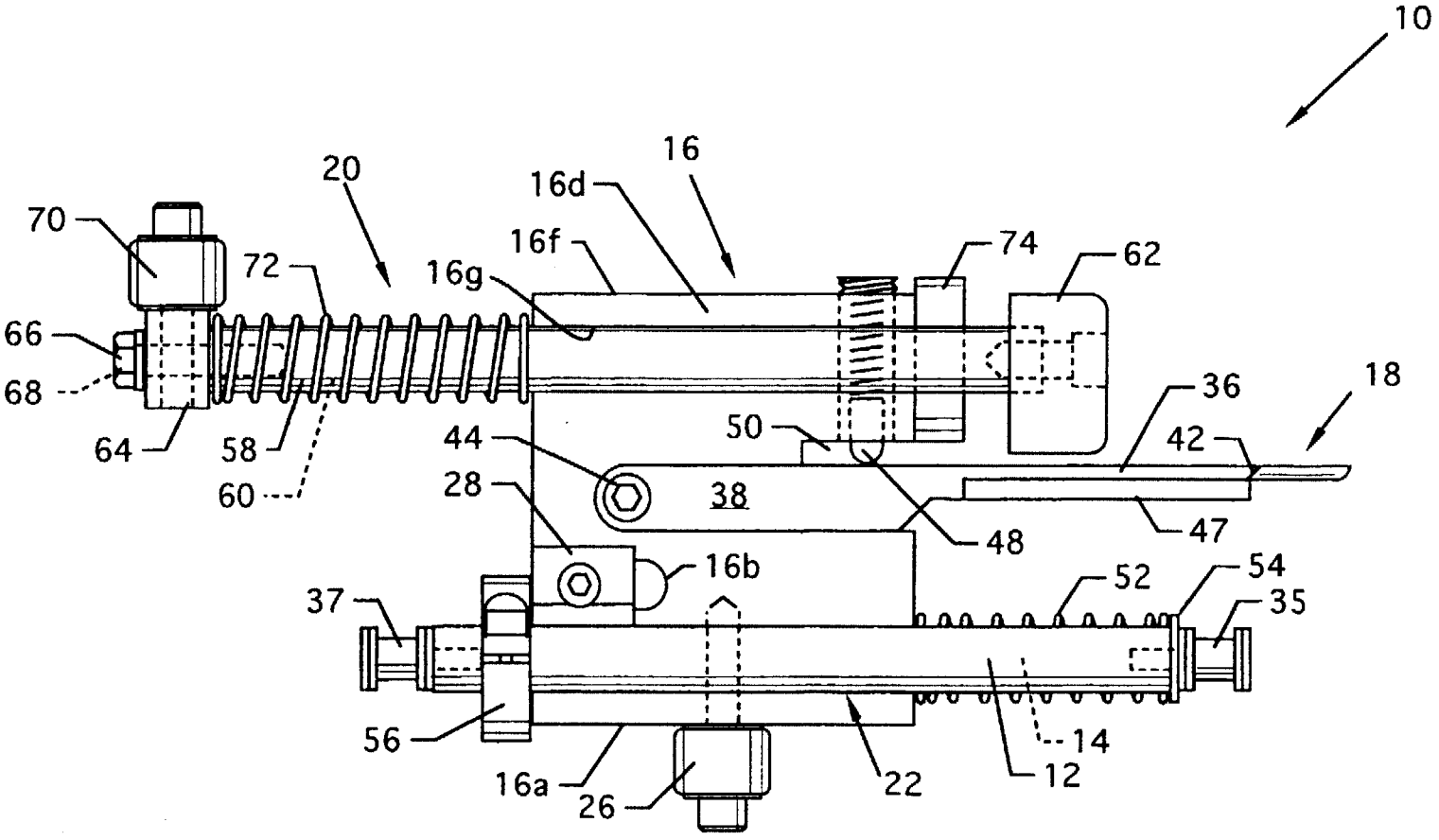
FIG. 2 illustrates a side view of the floating flap tucker assembly.
Figure 3:
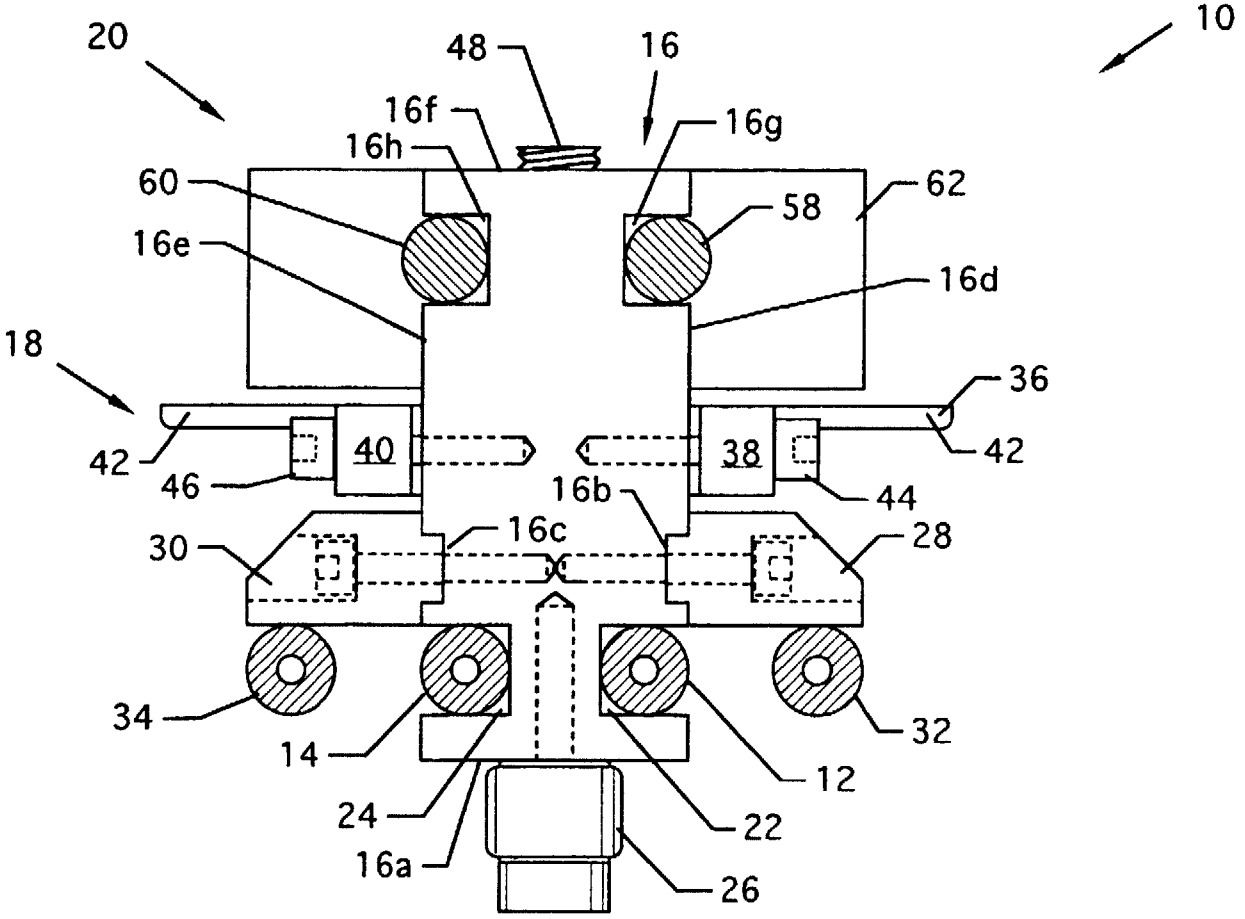
FIG. 3 illustrates a rear view of the floating flap tucker assembly.
Figure 4:
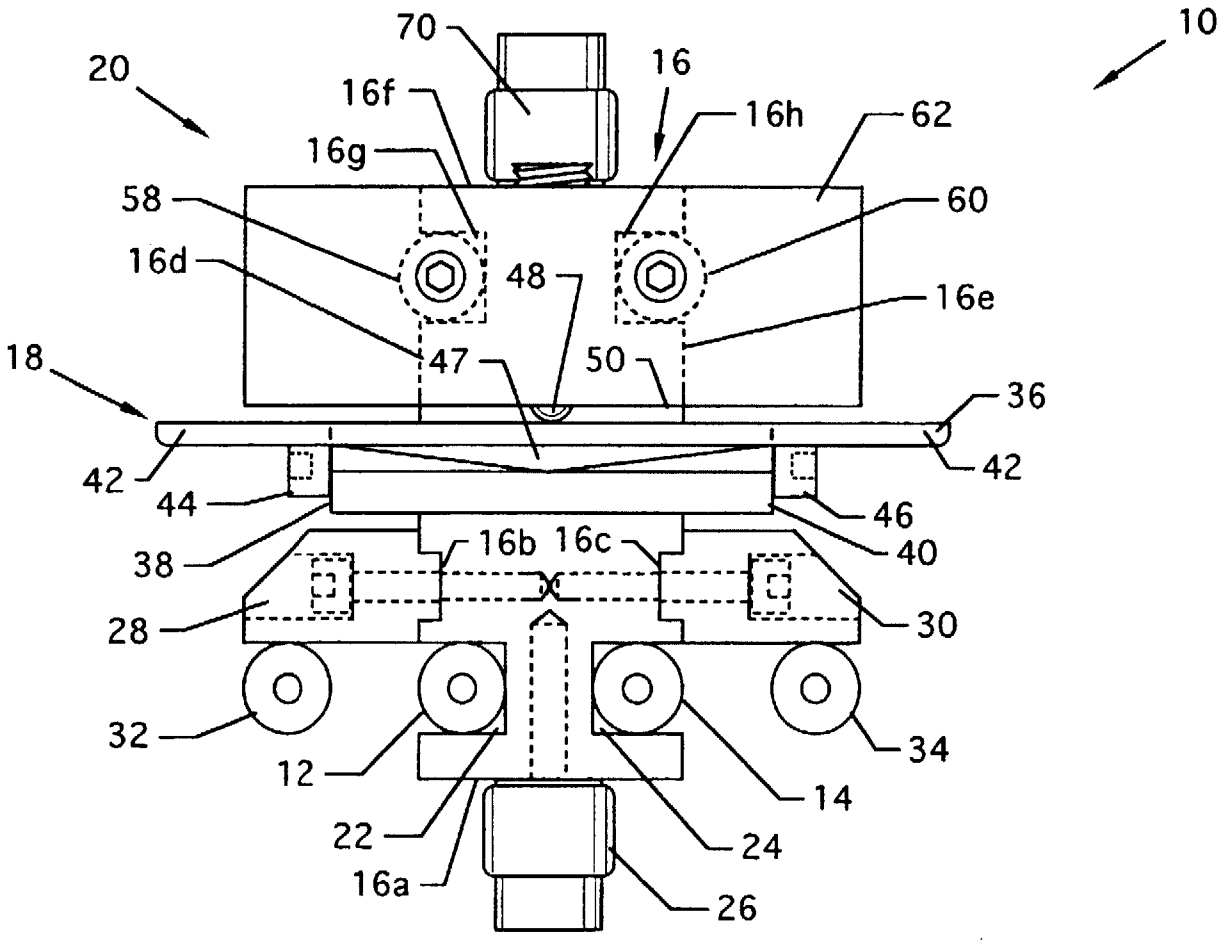
FIG. 4 illustrates a front view of the floating flap tucker assembly.

FIG. 1 illustrates an isometric view of a floating flap tucker assembly 10. FIG. 2 illustrates a side view of a floating flap tucker assembly 10. FIG. 3 illustrates a rear view of a floating flap tucker assembly 10, and FIG. 4 illustrates a front view of the floating flap tucker assembly 10, herein called the tucker assembly 10, which is used in conjunction with a tucker transporter system and cam actuating tracks as illustrated later in detail. With reference to FIGS. 1, 2, 3 and 4, the tucker assembly 10 is now described. The tucker assembly 10 is illustrated mounted on slide shafts 12 and 14. The tucker assembly 10 includes a configured slide body 16 upon which a pivotable tucker blade 18 is pivotally secured and a face closer assembly 20 which is slidingly secured. The entire tucker assembly 10, including the pivotable tucker blade 18 and the face closer assembly 20 is actuated by cam actuators later described in detail. The slide body 16 includes, at its lower portion, channels 22 and 24 corresponding in orientation to that of the slide shafts 12 and 14. Channels 22 and 24 align over and about the slide shafts 12 and 14 respectively in sliding engagement. A cam follower 26 is secured to the bottom 16*a* of the slide body 16 and is used for lateral and transversal actuation of the slide body 16 and attached members such as the pivotable tucker blade 18 and the face closer assembly 20 along slide shafts 12 and 14. Stabilizer members 28 and 30 secure with suitable hardware to channels 16*b* and 16*c* in sides 16*d* and 16*e* of the slide body 16 to lend support to the tucker assembly 10 during flap tucking and positioning. Stabilizers 28 and 30 are supported by support shafts 32 and 34, being of the same shape and construction as the slide shafts 12 and 14, each shaft being part of a tucker transporter system described later in detail. Support by support shafts 32 and 34 is not required at the ends of the tucker transporter system and is removed from intimate contact with the stabilizers 28 and 30 as the tucker assembly 10 passes about the end sprockets of the tucker transporter system 76 illustrated in FIGS. 5, 6 and 7. Support shafts 32 and 34 and slide shafts 12 and 14 are supported between a plurality of opposing like chain link members 35 and 37, each being part of the tucker transporter system 76 described later in detail.

The one piece pivotable tucker blade 18 pivotally secures to the sides 16*d* and 16*e* of the slide body 16. The horizontally aligned pivotable tucker blade 18 is generally in the shape of a yoke having a T-shaped planar blade member 36 supported by pivot arms 38 and 40. The outboard T-shaped portion of the planar blade member 36, which includes an interrupted beveled rearward surface 42, can be suitably sized or alternatively shaped to tuck and desired flap size as required. The inboard portion of the blade member 36 extends to include pivot arms 38 and 40 and extends into a cutout area 50 extending between sides 16*d* and 16*e* of the slide body 16. A contact member 47 having a triangular cross section, extends downwardly from the underside of the blade member 36 to slidingly contact a cam member later described in detail. The pivot ends of pivot arms 38 and 40 pivotally secure to sides 16*d* and 16*e* with pivot fasteners 44 and 46. A spring plunger assembly 48 located and secured through the top 16*f* extends downwardly through the slide body 16 and into cutout area 50 to exert downward force on the top surface of the blade member 36 to maintain the pivotable tucker blade 18 in the downwardly depressed position unless acted upon by cam forces. A return spring 52 mounts over and about the slide shaft 14 and between the slide body 16 and a stop 54 secured between chain link member 35 and the slide body 16 to return the slide body and its attached members to the unactuated position against a stop collar 56 located on slide shaft 12. In the alternative, additional springs can be aligned over and about the slide shaft 12 in the same fashion if desired.

Face closer assembly 20 slidably mounts to the upper region of the slide body 16. Opposing channels 16*g* and 16*h* in sides 16*d* and 16*e* slidingly accommodate upper slide shafts 58 and 60 which are aligned central to the face closer assembly 20. Slide shafts 58 and 60 extend partially into the face closer bar 62 and secure thereto by suitable fasteners extending through the face closer bar 62. Opposing ends of the slide shafts 58 and 60 secure against a cam mount bar 64 with bolts 66 and 68 extending through the cam mount bar 64 into the ends of slide shafts 58 and 60. A cam follower 70 secures in the top side of the cam mount bar 64. Also included in the face closer assembly 20 is a return spring 72 aligned over and about slide shaft 58 and between the slide body 16 and the cam mount bar 64. The cam follower 70 is used for inward and transversal actuation of the face closer assembly 20 by a cam track. Return spring 72 returns the face closer assembly 20 and its attached members to the unactuated position against a stop collar 74 located on slide shaft 60 as illustrated.

Figure 5:
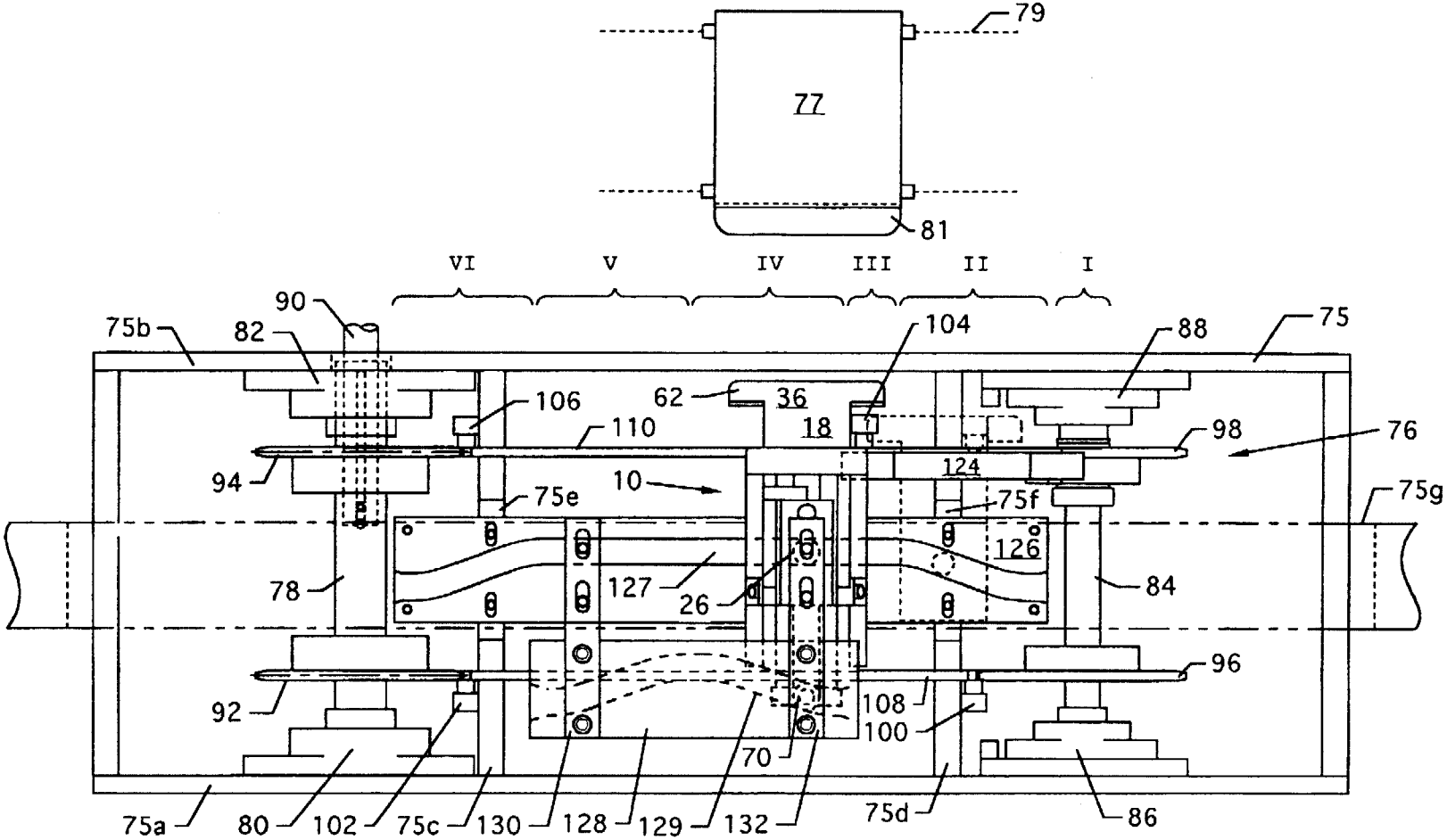
FIG. 5 illustrates a top view of a framework, the tucker transporter and a flap tucker assembly in parallel operation with a conveyor.
Figure 6:
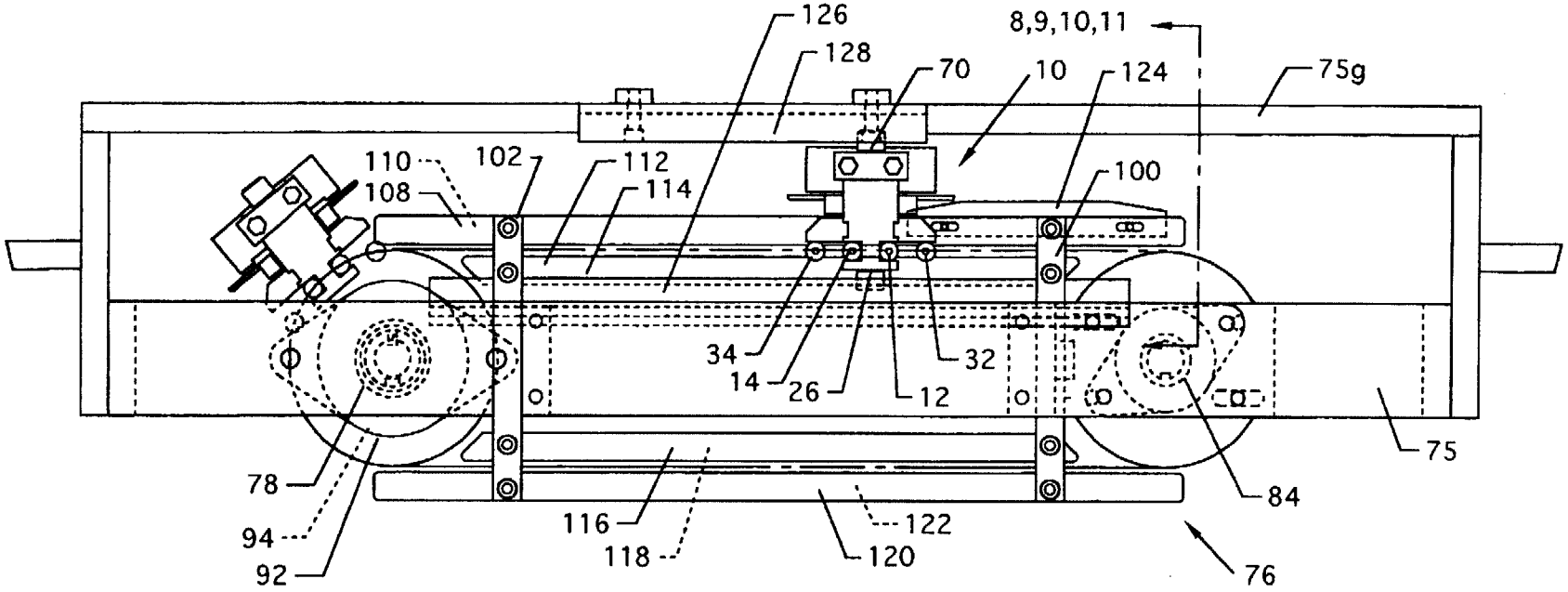
FIG. 6 illustrates a side view of the members of FIG. 5, excluding a parallel conveyor.
Figure 7:
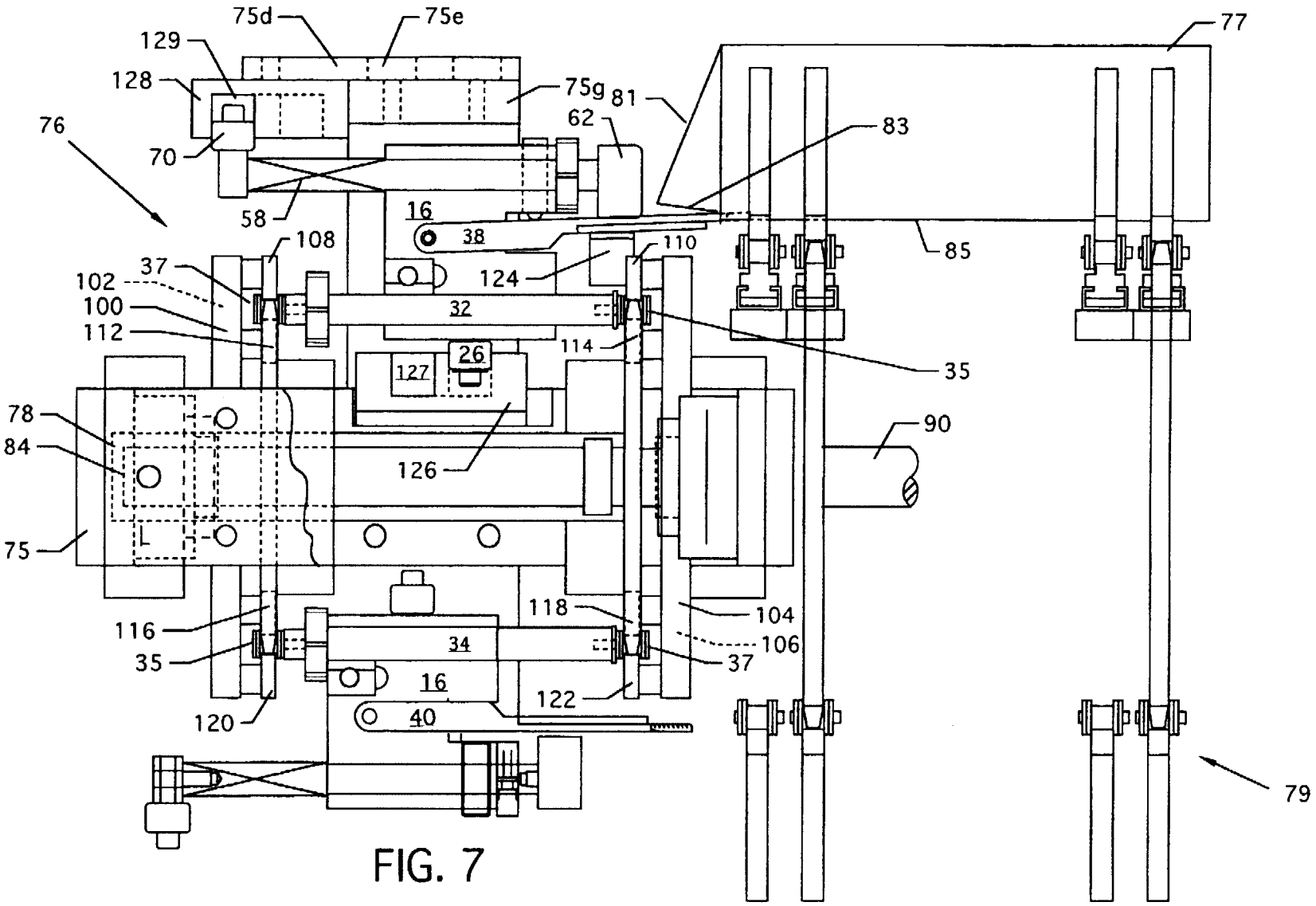
FIG. 7 illustrates an end view of the members of FIG. 5.

FIGS. 5, 6 and 7 illustrate a top view, a side view and an end view of a framework 75, each including a view of a tucker transporter system 76 and a plurality of actuation cam members located at various locations adjacent to and along the tucker transporter system 76 and framework 75. A box member 77 is also illustrated in FIGS. 5 and 7 being supported on a parallel conveyor system 79 which moves in concert with the tucker transporter system 76.

The tucker transporter system 76 includes a head shaft 78 aligned between framework mounted shaft bearings 80 and 82 and a tail shaft 84 aligned between framework mounted shaft bearings 86 and 88 and includes other members now described. A drive shaft 90 secures to and drives the headshaft 78. Opposing sprocket sets 92–94 and 96–98 align over and about the headshaft 78 and the tailshaft 84 respectively to support a plurality of chain links 35 and 37 between which a plurality of slide shafts 12 and 14 and support shafts 32 and 34 are supported. Support bars 100, 102, 104 and 106 extend vertically along the framework 75 to support upper region upper chain guides 108–110 and lower chain guides 112–114, as well as lower region upper chain guides 116–118 and lower chain guides 120–122.

A plurality of cam members are secured to the framework 75 and other members located at various locations adjacent to and along the tucker transporter system 76 including a blade actuation cam 124, a slide body actuation cam 126 having a slot 127 and a face closer actuation cam 128 having a slot 129. The blade actuation cam 124 adjustably secures to the upper chain guide 110 and vertically actuates the pivotable tucker blade 18 by interaction with contact member 47 of the pivotable tucker blade 18. Slide body actuation cam 126 adjustably secures in notched portions 75*e* and 75*f* of framework cross members 75*c* and 75*d* which align between framework members 76*a* and 75*b* to horizontally and transversely position the slide body 16 and attached components by interaction with cam follower 26 of the slide body 16. The face closer actuation cam 128 mounts to an overhead framework member 75*g* by adjustably secured bars 130 and 132 to horizontally and transversely position the face closer 62 by interaction with cam follower 70 of the face closer assembly 20.

MODE OF OPERATION

FIGS. 5 and 8–11 best illustrate the mode of operation, where all numerals correspond to those elements previously described. FIG. 5 illustrates the stages of operation of cam operation and member actuation of tucker assembly 10 along the length of the framework 75 and the tucker transporter system 76. FIGS. 8–11 illustrate the operation of the members of the tucker assembly 10 by various cam members previously described. A box member 77, having a major flap member 81 and a minor flap member 83, is conveyed parallel to each tucker assembly 10 and framework 75 at a compatible orientation and speed, but is shown offset from the framework 75 and tucker assembly 10 for purposes of brevity and clarity.

Figure 8:
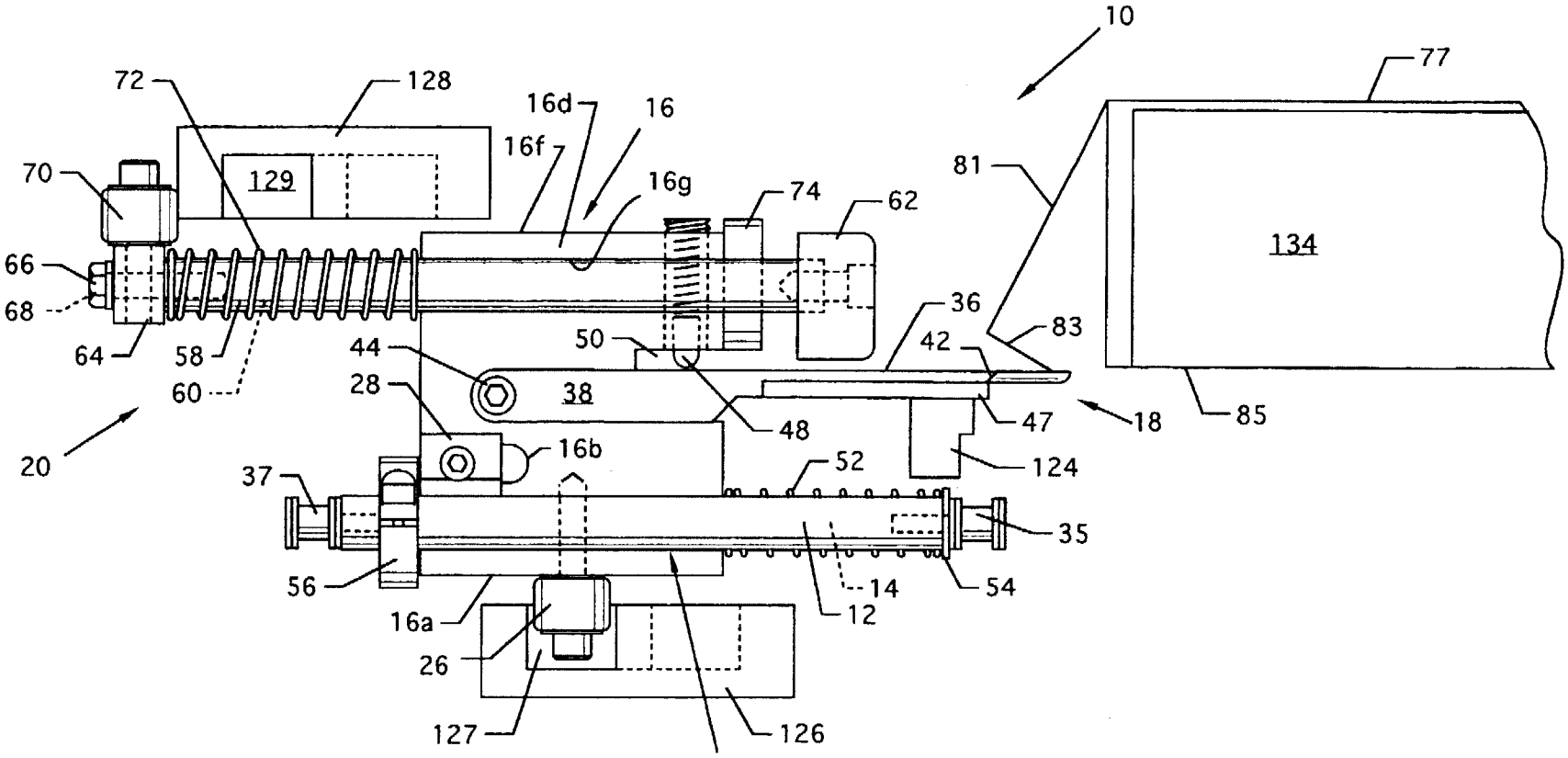
FIG. 8 illustrates Operational Stage I.

With reference to FIGS. 5 and 8, Operational Stage I is now described. The tucker assembly 10 is in the unactuated position just prior to engaging the blade actuation cam 124 and the slide body actuation cam 126. Cam followers 26 and 70 and the pivotable tucker blade 18 are presented to cams 126–128 and cam 124, respectively, as the tucker assembly 10 is carried along the tucker transporter system 76. Spring plunger 48 exerts downward pressure upon the blade member 36 at all times to force the blade member 36 downwardly at all times.

Figure 9:
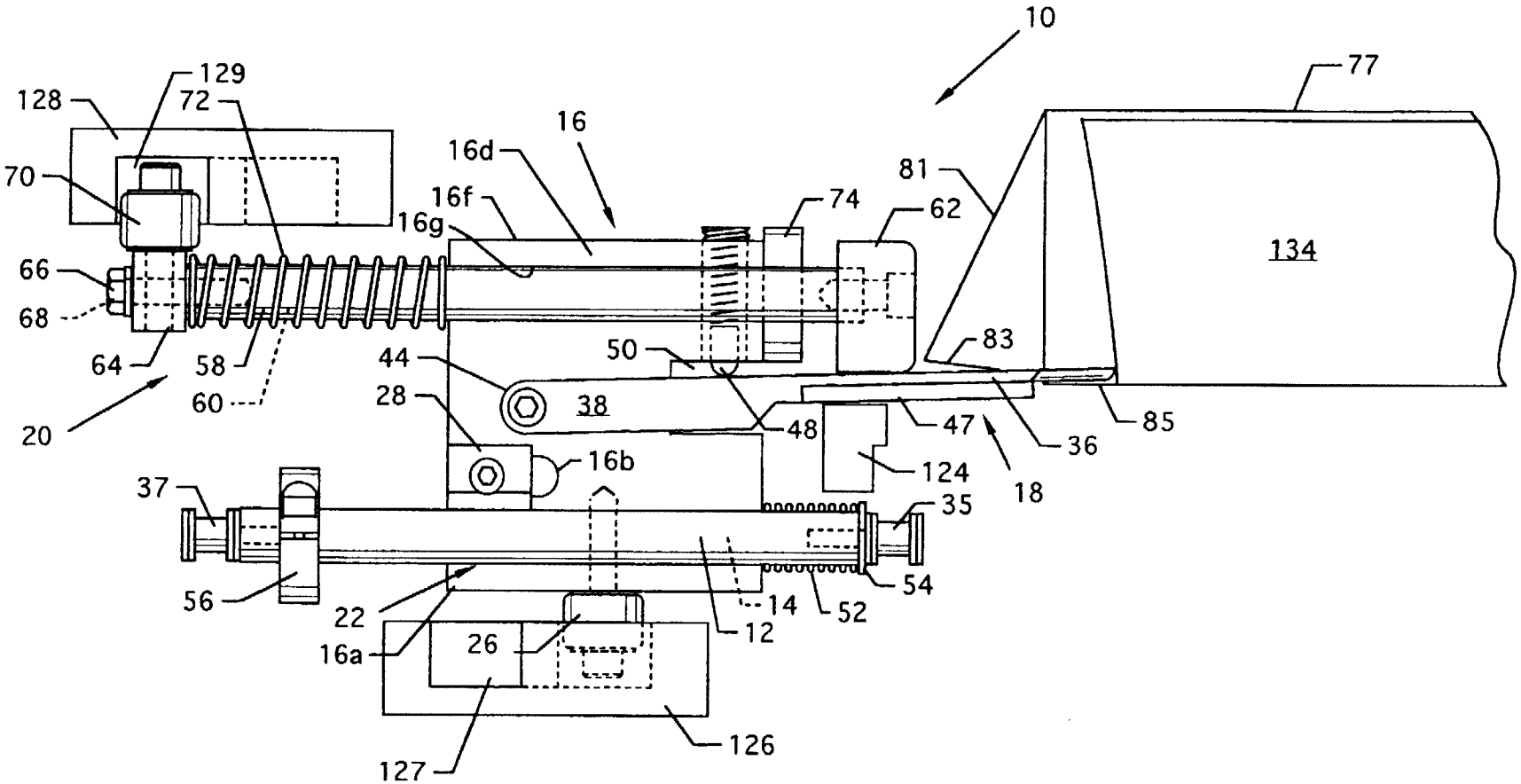
FIG. 9 illustrates Operational Stage II.

With reference to FIGS. 5 and 9, Operational Stage II is now described. The tucker assembly 10 is advanced along the tucker transporter system 76 to cause the contact member 47 of the pivotable tucker blade 18 to come in contact with blade actuation cam 124 for sustained pivotational elevation of the pivotable tucker blade 36 along the length of the blade actuation cam 124 to place the tip of the blade member 36 above the level of the bottom surface 85 of the box member 77. At the same time the pivotable tucker blade 18 is suitably actuated above the level of the bottom surface 85, follower cam 26 is positioned by slot 127 in the slide body actuation cam 126 to slidingly position the slide body 16 and its attached members, including the pivotable tucker blade 18, horizontally and transversely along slide shafts 12 and 14 to position the tip of the blade member 36 over and above the leading edge of the bottom surface 85 of the box member 77. When the box contents 134 is a flexible display separator, the blade member 18 can be utilized to deflect the lower flexible display separator edge prior to downward positioning of the blade members as illustrated in FIG. 9. During inward actuation of the slide body by cam follower 26, spring 52 is compressed between stop 54 and the body of the slide body 16 to position the slide body 16 and its associated members subsequent to cam disengagement for return about the underside of the tucker transport system 76. It is also noted that the tip of the blade member 36 can be incorporated to position box contents 134 away from the flap closing operation, if desired.

Figure 10:
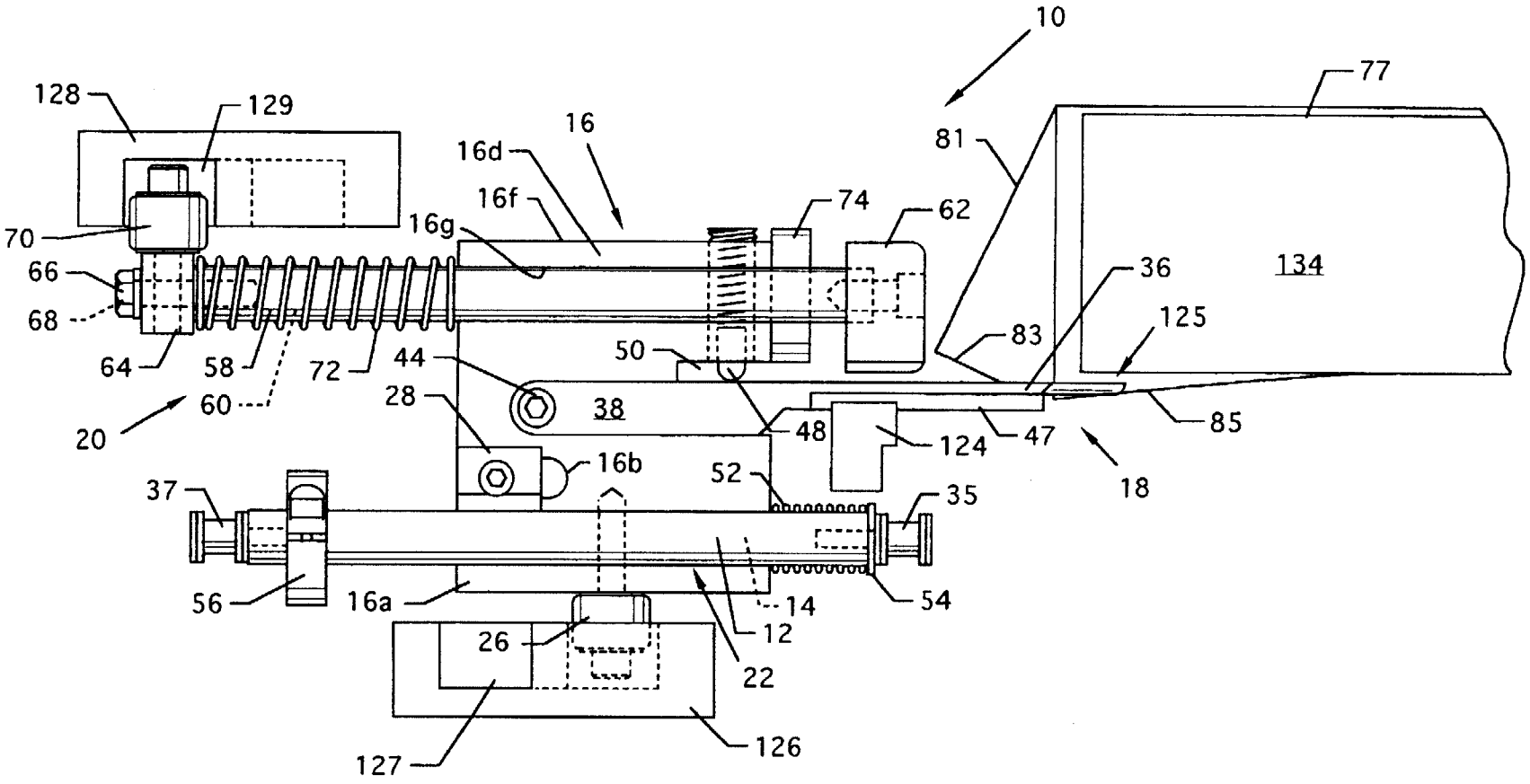
FIG. 10 illustrates Operational Stage III.

With reference to FIGS. 5 and 10, Operational Stage III is now described. The tucker assembly 10 is advanced and the pivotable tucker blade 18 is disengaged from contact with the blade actuation cam 124 thus allowing the spring plunger 48 to depressingly force the tip of the blade member 36 downwardly into intimate contact with the bottom surface 85 thus causing a portion of the bottom surface 85 to be distended downwardly for subsequent insertion and tucking of major and minor flap members 81 and 83 into the mouth of the box member 77. Downward distention of the bottom surface 85 creates a gap 125 between the lower surface of the box contents 134 and the bottom surface 85 for accommodation of the minor flap 83.

Figure 11:
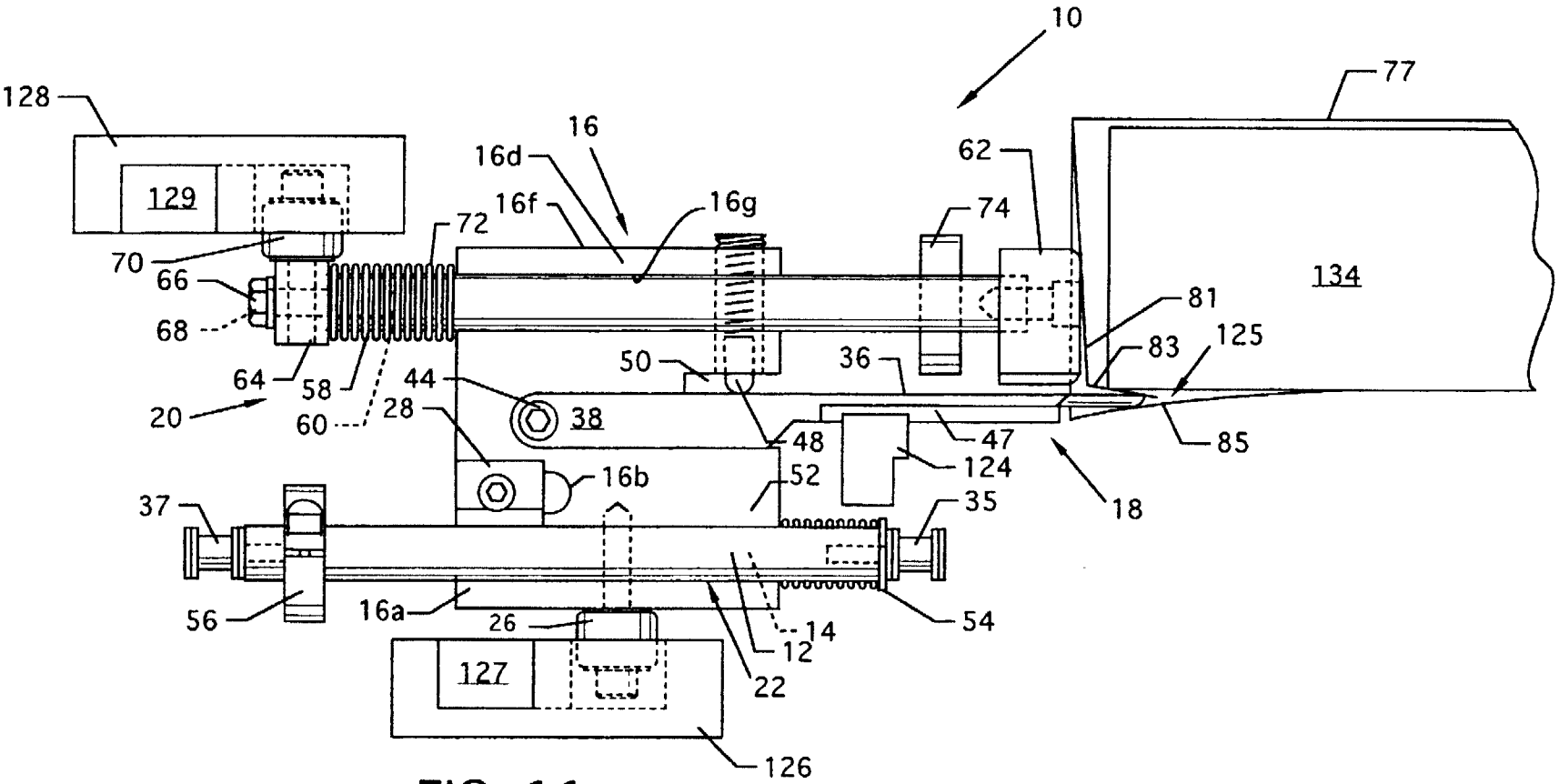
FIG. 11 illustrates Operational Stage IV.

With reference to FIGS. 5 and 11, Operational Stage IV is now described. The tucker assembly 10 is advanced to cause engagement of cam follower 70 with slot 129 of the face closer actuation cam 128 to actuate the face closer assembly 20 along slide body channels 16*g* and 16*h*. Actuation of the face closer assembly 20 causes the face closer 62 to come in intimate contact with the major flap 81 thus forcing the major flap 81 and the minor flap 83 well into the mouth of the box member 77. It is noted that the face closer 62 positions the flaps 81 and 83 beyond the periphery of the box member mouth to compensate for spring back of the flaps when the face closer 62 is removed in a further operational stage.

With reference to FIG. 5, Operational Stage V is now described. The tucker assembly 10 is advanced to cause further positioning and disengagement of cam follower 70 with slot 129 of the face closer actuation cam 128 to return the face closer assembly 20 to its neutral position along slide body channels 16*g* and 16*h* of FIG. 4. At this time, the face closer 62 is withdrawn from intimate contact with the major flap 81. Blade member 36 is still in contact with the bottom surface 85 of box member 77 and awaiting subsequent disengagement at Stage VI.

With reference to FIG. 5, Operational Stage VI is now described. The tucker assembly 10 is further advanced to cause further positioning and disengagement of the cam follower 26 with the slide body actuation cam 126 to return the slide body 16 to its neutral position and also causing the blade member 36 to be withdrawn from intimate contact with the bottom leading edge. One or more return springs, such as return springs 72 and 52, position the respective tucker assembly components for carriage about the unactuated portion of the tucker transporter.

Various modifications can be made to the present invention without departing from the apparent scope hereof.

I claim:

1. A tucker transporter system for folding a major and minor box container flap member on a box member that is being conveyed on a conveyer in parallel to said transporter system comprising:

a. a floating flap tucker assembly positioned adjacent said conveyed box member comprising:

(1) a slide body that moves horizontally toward and transversely in parallel with said conveyed box member comprising:

(a) a pivotable tucker blade pivotally attached to said slide body providing direct contact with and vertical distention of the bottom leading edge of said box member;

(b) a plurality of slide body slide shafts attached to said slide body to provide horizontal movement toward or away from said box member; and, (c) a slide body cam follower attached to said slide body slide shafts; and, (2) a face closer assembly attached to said slide body that moves horizontally toward and transversely in parallel with said conveyed box member comprising:

(a) a face closer bar that interfaces directly with said major box flap to close said major and minor flap member;

(b) a plurality of face closer slide shafts attached to said face closer bar to provide horizontal movement of said closer bar into contact with said box member; and, (c) a face closer cam follower attached to said face closer slide shaft; and, b. a tucker transporter assembly for transporting said floating flap tucker assembly in a direction horizontally toward and transversely in parallel with said conveyed box member comprising:

(1) a face closer actuation cam to provide horizontal and transverse directionality to said face closer cam follower;

(2) a slide body actuation cam to provide horizontal and transverse directionality to said slide body cam follower;

(3) a blade actuation cam to provide vertical pivotal movement to said pivotal tucker blade; and, (4) a framework to support said floating flap tucker assembly and said tucker transport assembly.

2. A tucker transporter system for folding a major and minor box container flap member on a box member that is being conveyed on a conveyer in parallel to said transporter system comprising:

a. a floating flap tucker assembly positioned adjacent said conveyed box member comprising:

(1) a slide body that moves horizontally toward and transversely in parallel with said conveyed box member comprising:

(a) a pivotable tucker blade pivotally attached to said slide body providing direct contact with and vertical distention of the bottom leading edge of said box member;

(b) a plurality of slide body slide shafts attached to said slide body to provide horizontal movement toward or away from said box member; and, (c) a slide body cam follower attached to said slide body slide shafts; and, (2) a face closer assembly attached to said slide body that moves horizontally toward and transversely in parallel with said conveyed box member comprising:

(a) a face closer bar that interfaces directly with said major box flap to close said major flap member;

(b) a plurality of face closer slide shafts attached to said face closer bar to provide horizontal movement of said closer bar into contact with said box member; and, (c) a face closer cam follower attached to said face closer slide shaft; and, b. a tucker transporter assembly for transporting said floating flap tucker in a direction horizontally toward and transversely in parallel with said conveyed box member comprising actuation cams that position and drive said slide body cam follower, said face closer cam follower, and said pivotable tucker blade.

3. The system of claim 2, wherein said floating flap tucker assembly is moving transversely in parallel along with and adjacent to said box member being conveyed on said conveyer, as said major and minor flap members are being closed by said floating flap tucker assembly.

4. The system of claim 2, wherein said slide body further comprises a plurality of stabilizer members that slide upon a plurality of support shafts.

5. The system of claim 2, wherein said slide body further comprises a slide body return spring positioned over at least one of said slide body slide shafts applying a force tending to move said slide body to horizontal position away from said box member.

6. The system of claim 2, wherein said slide body further comprises a chain link member to allow for transverse transporting of said floating flap tucker assembly.

7. The system of claim 2, wherein said face closer assembly further comprises opposing channels that provide a sliding track for said face closer slide shafts.

8. The system of claim 2, wherein face closer assembly further comprises a face closer return spring positioned over at least one of said face closer slide shafts applying a force tending to move said face closer bar horizontally away from said box member.

9. The system of claim 2, wherein said pivotable tucker blade moves horizontally into the mouth of said box member due to horizontal movement of said slide body.

10. The system of claim 2, wherein a spring plunger assembly attached to said slide body pushes downward on said pivotable tucker blade to vertically distend said bottom leading edge of said box member.

11. The system of claim 10, wherein said pivotal tucker blade depresses said bottom leading edge of said box member downward providing a gap to accommodate said minor flap member.

12. The system of claim 10, wherein said spring plunger assembly is adjustable to alter the force imparted by said spring plunger assembly onto said pivotable tucker blade.

13. The system of claim 2, wherein said pivotable tucker blade comprises a triangular-shaped contact member for contact with said blade actuation cam.

14. A tucker transporter system for folding a major and minor box container flap member on a box member that is being conveyed on a conveyer in parallel to said transporter system comprising:

a. a floating flap tucker assembly positioned adjacent said conveyed box member comprising:

(1) a slide body that moves horizontally toward and transversely in parallel with said conveyed box member comprising:

(a) a pivotable tucker blade pivotally attached to said slide body providing direct contact with and vertical distention of the bottom leading edge of said box member;

(b) a plurality of slide body slide shafts attached to said slide body to provide horizontal movement toward or away from said box member;

(c) a slide body cam follower attached to said slide body slide shafts; and, (d) a chain link member attached to said slide body; and, (2) a face closer assembly attached to said slide body that moves horizontally toward and transversely in parallel with said conveyed box member comprising:

(a) a face closer bar that interfaces directly with said major box flap to close said major flap member;

(b) a plurality of face closer slide shafts attached to said face closer bar to provide horizontal movement of said closer bar into contact with said box member; and, (c) a face closer cam follower attached to said face closer slide shaft; and, b. a tucker transporter assembly for transporting said floating flap tucker in a direction horizontally toward and transversely in parallel with said conveyed box member comprising:

(1) a face closer actuation cam to provide horizontal and transverse directionally to said face closer cam follower;

(2) a slide body actuation cam to provide horizontal and transverse directionally to said slide body cam follower;

(3) a blade actuation cam to provide vertical pivotal movement to said pivotal tucker blade;

(4) a chain guide which positions a drive means attached to said chain link member of said slide body, said drive means providing transverse movement to said slide body; and (5) a framework to support said floating flap tucker assembly and said tucker transport assembly.

15. The system of claim 14, wherein said floating flap tucker assembly is returned transversely by said tucker transporter system in a direction opposite to that of said conveyed box member such that a flap member from another box member being conveyed is then folded by said tucker transporter system.

16. The system of claim 14, further comprising the steps of:

a. vertically raising said tucker blade above said bottom leading edge of said box member;

b. moving said slide body and tucker blade horizontally toward said box member inserting said blade member into the mouth of said box member;

c. forcibly depressing said blade member downward to distend said bottom leading edge of said box member creating a gap space;

d. moving said face closer bar horizontally into contact with said major flap and forcing said minor flap of said box member into said gap space;

e. withdrawing said face closer bar horizontally away from said box member;

f. withdrawing said blade member horizontally away from said box member; and, g. all of said steps being performed as said box member is being conveyed on a conveyer and said floating flap tucker assembly is moving transversely along with said box member.

17. The process of folding a major and minor flap member of a box member moving on a parallel conveyer belt adjacent to a tucker transporter system comprising a tucker transporter assembly comprising a slide body cam, a blade actuation cam, a face closer actuation cam, and drive means which transports parallel to said conveyer a floating flap tucker assembly comprising a slide body with a pivotable tucker blade that moves horizontally toward said box member and vertically downward as said slide body is following along transversely in parallel with said box member and comprising a face closer assembly attached to said slide body to apply pressure to close said flap member, the steps comprising:

a. actuation of said pivotable tucker blade by said blade actuation cam for sustained pivotable blade elevation to place the tip of said pivotable tucker blade above the level of a bottom box surface;

b. actuating said slide body cam to slidingly position said slide body and attached members, including said pivotable tucker blade horizontally and transversely along slide shafts to position the tip of said pivotal tucker blade over and above the leading edge of said bottom box surface;

c. disengagement of pivotable tucker blade from contact with said blade actuation cam and positioning of said blade actuation cam by a spring plunger to forcibly depress said tucker blade downwardly into intimate contact with said box bottom surface to downwardly distend said bottom box surface and create minor flap accommodation gap;

d. actuating said face closer actuation cam to position a face closer assembly along slide body channels to cause a face closer to come in intimate contact with and force major and minor flaps beyond the mouth of said box member and to position said minor flap in said gap between said bottom box surface and said depressed pivotable blade;

e. actuation of said face closer cam to return said face closer assembly to its neutral position along said slide body channels to be withdrawn from intimate contact with said major flap; and, f. actuation of said slide body actuation cam to return said slide body and attached pivotable blades to a position withdrawn from intimate contact with said bottom box surface.

* * * * *